United States Patent [19]

Sanford

[11] Patent Number: 4,794,214

[45] Date of Patent: Dec. 27, 1988

[54] FLUID PRESSURE RESPONSIVE ELECTRICAL SWITCH

[75] Inventor: Carlton E. Sanford, E. Providence, R.I.

[73] Assignee: Texas Instruments Incorporated, Dallas, Tex.

[21] Appl. No.: 114,184

[22] Filed: Oct. 28, 1987

[51] Int. Cl.[4] ..... H01H 35/34

[52] U.S. Cl. ..... 200/83 P; 200/83 J; 200/83 W; 337/343

[58] Field of Search ..... 200/83 Y, 83 W, 83 R, 200/83 J, 83 P, 302.1, 81.4, 81.5; 337/343; 91/1; 92/5 R, 98 R, 101; 73/861.47, 717, 723; 340/626; 307/118

[56] References Cited

U.S. PATENT DOCUMENTS

| | | | |
|---|---|---|---|
| 4,400,601 | 8/1983 | Brucken | 200/83 W |
| 4,581,509 | 4/1986 | Sanford | 337/343 |
| 4,591,677 | 5/1986 | Hirota | 200/83 P |

*Primary Examiner*—G. P. Tolin

*Attorney, Agent, or Firm*—John A. Haug; James P. McAndrews; Melvin Sharp

[57] ABSTRACT

A fluid pressure switch is shown including first and second discs each having convex-concave surface configurations on opposite sides thereof adapted to invert its configuration upon being subjected to selected pressure levels. A slidably disposed plural stage pressure converter having a flexible membrane on one side thereof is operatively coupled to the discs to transfer force from fluid pressure received by the membrane. A motion transfer member extends from the second disc to an electric switch. At a first range of pressures the first disc prevents actuation of the switch, at a second range of pressures the curvature of the first disc has inverted allowing actuation of the switch while at a third range of pressures the curvature of the second disc has inverted resulting in deacuation of the switch.

7 Claims, 1 Drawing Sheet

FLUID PRESSURE RESPONSIVE ELECTRICAL SWITCH

BACKGROUND OF THE INVENTION

This invention relates generally to electrical switches and more particularly to switches using spring disc elements which move between opposite convex and concave configurations and which are actuated upon the occurrence of selected conditions such as pressure. This application includes subject matter also contained in copending, coassigned application Ser. No. 114,487 filed 10/28/87 which is a continuation-in-part of Ser. No. 946,438, filed 12/23/86, now abandoned.

Conventional condition responsive switches have a contact arm movable between first and second switch positions prebiased to one switch position and have a dished snap acting disc element movable between opposite convex and concave configurations for moving the contact arm between switch positions in response to the occurrence of selected temperature or pressure conditions. Such switches are intended to perform selected control functions in response to the occurrence of the selected temperature or pressure conditions in a zone to be monitored. An example of a switch of this type is shown and described in U.S. Pat. No. 4,581,509 which issued to the assignee of the present invention.

This type of switch has become widely used, among other applications, in automotive environments such as in air conditioning refrigeration compressor systems. For example there is a need in such a system to provide a switch to protect the system from excessive high pressure. Additionally, there is a need to provide a switch to protect the system from a loss of freon and lubricant charge and resulting compressor damage. Both of these switches are connected to operate the compressor clutch either directly or through a computer control system and are typically mounted in the compressor housing and communicate with the high pressure side of the system. The high pressure protection device typically opens on pressure increase to about 430 psi while the high side low pressure switch typically closes on pressure increase to 50 psi.

In copending application Ser. No. 114,487, referenced supra, an improved switch is shown comprising a normally open electric switch mounted adjacent first and second vertically aligned discs adapted to move from one dished configuration to an opposite dished configuration upon the occurrence of selected conditions. The first disc has a normally concave surface configuration facing the switch and has a centrally disposed aperture through which a motion transfer pin extends between a movable contact arm of the electric switch and the second disc having a normally convex surface configuration facing toward the switch. The second disc is mounted in a pressure-force converter which is adapted to move the second disc toward a reaction surface. The first disc is adapted to invert its curvature upon being exposed to increasing pressures of a selected first level or above, and the second disc is adapted to invert its curvature upon being exposed to increasing pressures of a selected second, high level or above. At pressures below the first level, the first disc prevents actuation of the switch and at pressures above the second level the second disc allows deactuation of the switch.

The switch described above is very effective in combining functions in a single housing thereby conserving space and material, however, in using a diaphragm or membrane as a means of communicating fluid pressure to the switch mechanism the added displacement required of the membrane produces stresses which may reduce the number of cycles to which the membrane can be subjected during its useful life. Further, the use of the pressure converter described in the copending application may effect the specific amplification factors required for each disc making their selection with regard to factors such as yield, reliability and fatigue life more critical. That is, one disc has a low pressure amplification factor required for its actuation while the other has a high pressure amplification factor required for its actuation.

It is therefore an object of the present invention to provide apparatus which will extend the useful life of the membrane used as a means of communicating fluid pressure to a switch mechanism, particularly in a device having more than a single function. Another object is the provision of apparatus which reduced the criticality of the selection of discs used to actuate the switch.

Briefly, in accordance with the invention a fluid pressure switch has a flexible membrane for communicating fluid pressure to a switch mechanism through a movable pressure-force converter. The converter comprises at least two portions movable relative to one another in engagement with the membrane and stop means to limit movement of one portion relative to the other portion so that both first and second portions are movable in response to selected pressure levels until the stop means limits movement of the one portion while the other portion continues to be movable at increased pressure levels.

According to a feature of the invention when used with a dual function pressure switch having first and second discs movable between convex and concave configurations, the first and second portions of the pressure converter form a first area and move together in response to increases in pressure to effect the actuation of the first disc and the second portion of the pressure converter forms a smaller area and is movable in response to further increases in pressure to effect the actuation of the second disc.

BRIEF DESCRIPTION OF THE DRAWINGS

Other objects, advantages and details of the condition responsive device of this invention appear in the following detailed description of the preferred embodiment of the invention, the detailed description referring to the drawings in which.

Figure 1:
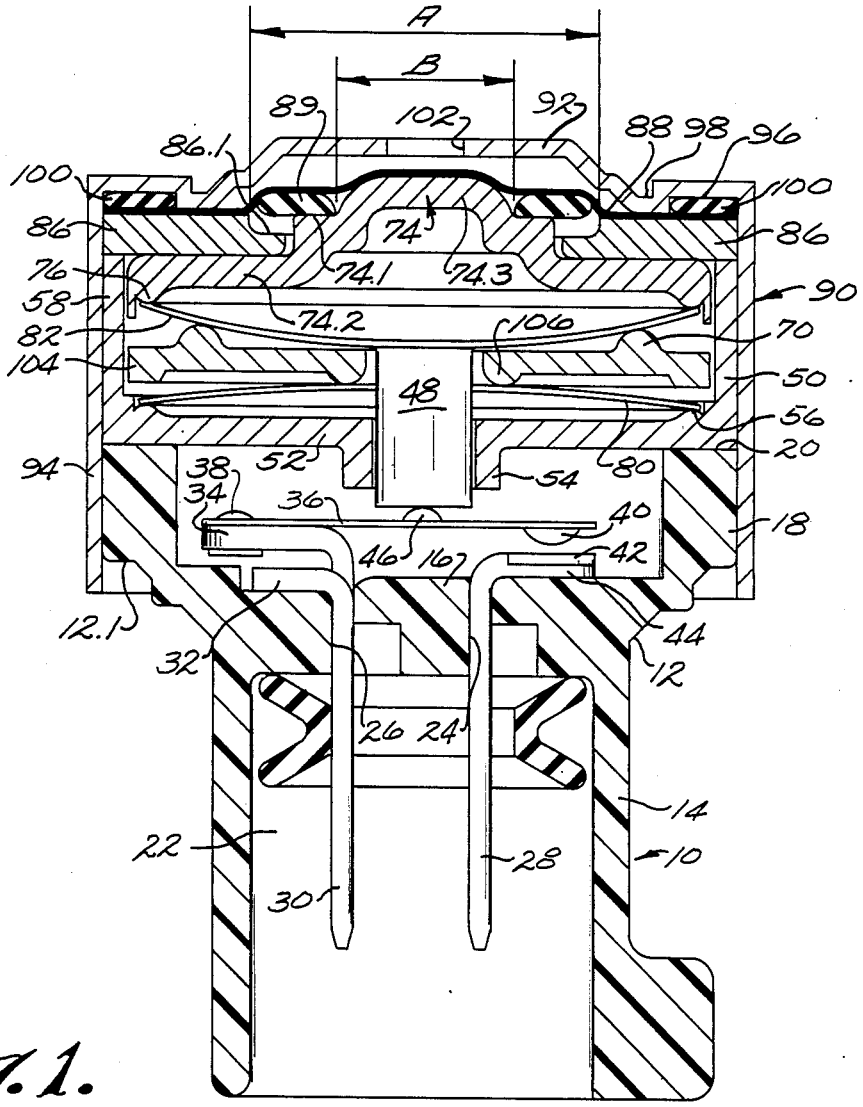
FIG. 1 is a sectional view along the longitudinal axis of a fluid pressure responsive switch in the open contacts position made in accordance with the invention.
Figure 2:
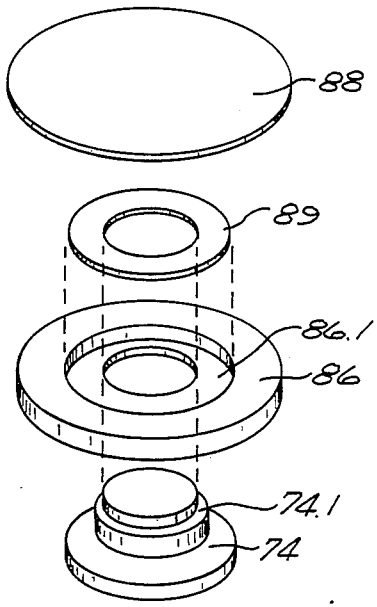
FIG. 2 is a blown apart perspective view of the pressure-force converter assembly used in the FIG. 1 switch.

Dimensions of certain of the parts as shown in the drawings may have been modified to illustrate the invention with more clarity.

Corresponding reference characters indicate corresponding parts throughout the several views of the drawings.

DESCRIPTION OF THE PREFERRED EMBODIMENT

Referring to the drawings, numeral 10 in FIG. 1 indicates a dual condition responsive device made in accordance with the invention which includes a housing comprising a base 12 preferably molded in one piece using a suitable rigid electrically insulative material such as glass filled nylon or the like. The base preferably has a cylindrical configuration including a cylindrical intermediate part 14, a bottom wall 16 and cylindrical side wall 18 which has a flat distal mounting surface 20. Intermediate part 14 is formed with a hollow portion 22 to form a terminal enclosure. Bottom wall 16 is provided with first and second apertures 24 and 26 and receive therethrough terminal members 28 and 30 respectively. Terminal 30 has a shelf 32 received on wall 16 and a platform 34 spaced above wall 16 and extending away from terminal 28. A flexible, electrically conductive movable contact arm 36 formed of material having good spring characteristics such as beryllium copper or the like is mounted on platform 34 in cantilever fashion by suitable means such as rivet 38. A movable contact 40 of suitable contact material is mounted on the free distal end of arm 36 in any conventional manner, such as by welding, and is adapted to move into and out of circuit engagement with a stationary contact 42 mounted on a shelf 44 of terminal 28 received on wall 16. Contact 42 formed of suitable contact material is shown as an inlaid portion of shelf 44, however, the contact could be separately attached if desired. A dimple 46 is preferably formed in movable arm 36 to provide more uniform motion transfer characteristics from a motion transfer pin 48 to be described below.

A metallic disc element support and motion transfer pin guide member 50 is received on the flat distal surface 20 of base 12 and comprises a generally circular bottom wall 52 with a centrally disposed downwardly extending wall 54 forming a bore adapted to slidingly receive motion transfer pin 48. An annular disc seat 56 is formed in the upper portion of wall 52 adjacent upwardly extending wall 58 which slidingly receives a pressure converter 74 formed with a disc receiving seat 76 in its bottom surface adjacent the outer periphery of the converter.

After the disc assembly and pressure converter assembly described below are placed in the housing, a metallic pressure divider and support ring 86 is placed on the top edge of wall 58 with a flexible membrane or diaphragm 88 of Teflon coated Kapton or the like disposed over the opening in ring 86.

A cup shaped metallic shell 90 has a top wall 92 and is preferably deep drawn to form a depending side wall 94 with a gasket receiving channel 96 formed in top wall 92 adjacent the outer periphery of the shell. An annular stop surface 98 is also formed in top wall 92 for a purpose to be described below. A gasket 100 such as a suitable, compressible "O" ring is placed in channel 96 and after the disc assembly and pressure converter assembly are placed in the housing shell 90 is placed over diaphragm 88, ring 86 and member 50 and is drawn against these elements to compress gasket 100 a selected amount determined by the location of stop surface 98. The lower distal end of depending wall 94 is crimped (not shown) over a flange 12.1 of base 12 in a conventional manner.

A suitable orifice 102 is provided in top wall 92 so that the switch can be placed in position to monitor the pressure of a fluid at a described location.

A first disc 80 having a centrally disposed aperture to accommodate motion transfer pin 48 and having a downwardly concave surface configuration at pressures below a first pressure level with respect to increasing pressure is disposed at seat 56 and a second disc 82 having a downwardly convex surface configuration at pressures below a second, higher pressure level with respect to increasing pressure is disposed at seat 76.

The disc assembly includes discs 80 and 82 formed of a spring material such as stainless steel or a thermostat bimetal or the like which are adapted to move between original and inverted configurations in response to the occurrence of selected pressure or temperature conditions or the like in a conventional manner.

An amplifier ring 104 is interposed between discs 80 and 82 and is free to move vertically along wall 58. Amplifier ring 104 is formed with an annular ridge 70 on its top surface adjacent its outer periphery and is adapted to engage disc 82. On its lower surface around its central bore a ridge 106 is formed adapted to engage disc 80.

The pressure converter assembly includes converter 74 comprising a generally circular shaped body having a centrally disposed button area 74.3 adapted to engage membrane 88 surrounded by a shelf 74.1 spaced downwardly therefrom. A laterally extending wall portion 74.2 is spaced downwardly from shelf 74.1 and extends outwardly therefrom. A converter ring 89 having a top surface adapted to engage membrane 88 is disposed on shelf 74.1 and extends laterally beyond the shelf. Support ring 86, disposed on the distal end portion of wall 58, is formed with a recessed annular shelf or stop surface 86.1 adapted to receive thereon converter ring 89 as it moves downwardly and limit the ring's downward motion.

Converter 74 is recessed to permit disc 82 to snap through to its opposite upwardly convex configuration upon the occurrence of preselected conditions.

When used in the application referenced supra of an automotive air conditioning refrigeration compressor, operation is permitted only when the high side pressure is between first and second pressure levels of increasing pressure. Disc 80 is selected so that it will invert its configuration from that shown in FIG. 1 to its opposite configuration at a first pressure level with increasing pressure, for example 47 psi. Disc 80 can be of the type which inverts its configuration with snap action or, if desired, if a narrower differential pressure is preferred (i.e., the difference in pressure between the pressure at which it moves from FIG. 1 to its opposite configuration and the pressure at which it moves back to the FIG. 1 configuration) a disc which is formed to exhibit less snap action can be employed. In any event disc 80 will invert to its original configuration on decreasing pressure at a somewhat lower level, for example 40 psi.

Disc 82 is selected, on the other hand, so that it will invert from its FIG. 1 configuration to its opposite configuration at a second, higher pressure with increasing pressure, such as 430 psi. Preferably disc 82 is chosen to move between its configuration with snap movement. On decreasing pressure disc 82 will invert to its original configuration at a somewhat lower level relative to its actuation level on increasing pressure, for example 200 psi.

FIG. 1 depicts the switch when the fluid in communication with orifice 102 is less than 47 psi starting from a lower pressure, for example from an at rest essentially 0 psi. Downward movement of diaphragm 88 and pressure converter 74 is limited by disc 80 acting through amplifier ring 104 and disc 82. It will be seen that contact 40 is out of engagement with contact 42 at such pressures ensuring that if there is an inadequate freon charge, the compressor cannot be actuated.

Once the pressure builds up to and exceeds 47 psi the force exerted on disc 80 causes it to invert to its opposite configuration allowing converter 74 to move motion transfer pin 48 through disc 80 until contact 40 moves into engagement with stationary contact 42. This represents the normal operating condition of the system monitored by the switch wherein the contacts are maintained in engagement between the first pressure level and a second higher pressure level.

Should the pressure build up to the second level, the force exerted on disc 82 through ridge 70 engaging the lower surface of the disc causes the disc to invert to its downwardly concave configuration thereby allowing the normal bias of movable spring arm 36 to move motion transfer pin 48 upwardly and allowing contact 40 to move out of engagement with stationary contact 42 thus deactivating the compressor in the event of pressures exceeding a selected level.

As pressure increases up to the level which causes disc 80 to actuate or snap to its opposite configuration both portions of the pressure converter move downwardly. That is, the central surface portion or button 74.3 of body 74 and ring 89 form a movable area A as seen in FIG. 1. When disc 80 snaps to its opposite configuration and portions 74 and 89 move downwardly the motion of ring 89 will be limited by stop surface 86.1 so that the movable portion of the converter with further increase in pressure will be only the smaller central area 74.3 of body 74 or movable area B as seen in FIG. 1. This smaller area requires a larger pressure to generate the force and displacement necessary to actuate disc 80.

Thus the invention lowers the stresses in the membrane by staging the deflection at two selected diameters A and B rather than concentrating all deflection at one diameter. The lower force disc is operated by pressure exerted on a larger area of the membrane (low amplification) while the higher force disc is operated by pressure exerted over a smaller area of the membrane (high amplification). The different amplification factors allow each corresponding disc to be manufactured for optimum yield, reliability and fatigue life.

It will be understood that it is within the purview of the invention to use two or more stages with other types of pressure switches where it is desired to obtain increased motion of the membrane without concentrating bending stresses.

It should be understood that although particular embodiments of the dual condition responsive switch of this invention have been described by way of illustrating the invention, the invention includes all modifications and equivalents of the disclosed embodiments falling within the scope of the appended claims.

What is claimed:

1. A fluid pressure switch device comprising a housing, an electric switch mounted in the housing, the switch having contacts movable relative to one another into and out of positions of engagement, first and second discs movable between convex and concave configuration and movably controlling the position of the contacts, the first disc having a centrally located aperture mounted in the housing, said first disc movable from one configuration to another at a first pressure level, the second disc mounted in the housing aligned with and beneath the first disc and moves from one configuration to another at a second higher pressure level, a motion transfer member slidably extending from the contacts through the aperture in the first disc and contacting the second disc, a pressure converter slidably mounted in the housing having an annular disc receiving seat, the second disc received at the seat, a flexible membrane in engagement with an opposite side of the pressure converter, an orifice formed in the housing so that the membrane can be placed in communication with a pressure source, the pressure converter having first and second portions movable relative to one another in engagement with the flexible membrane and stop means limiting movement of one portion while permitting movement of the other portion, both first and second portions being movable in response to selected pressure levels to effect movement of the first disc from one configuration to another and until the stop means limits movement of the one portion and at increased pressure levels the other portion being movable to effect movement of the second disc from one configuration to another.

2. A fluid pressure switch according to claim 1 in which the pressure converter comprises a body formed with a shelf, said one portion comprising a converter member received on the shelf, the converter member having a section projecting laterally beyond the shelf, the stop means adapted to engage the laterally projecting section.

3. A fluid pressure switch according to claim 2 in which the body is generally circular in configuration with an annular shelf and the converter member is generally ring shaped, the said other portion comprising the surface of the body within the annular shelf.

4. a fluid pressure switch device comprising a housing, an electrical switch mounted in the housing, the switch having first and second contacts movable relative to one another into and out of position of engagement with one another, a pressure converter movably mounted in the housing, operatively coupled to the contacts to movably control the position of the contacts relative to one another, a flexible membrane in engagement with the pressure converter, an orifice formed in the housing so that the membrane is placed in direct communication with a fluid pressure source, the pressure converter having first and second positions movable relative to one another and in engagement with the flexible membrane, and stop means limiting movement of one portion while permitting continued movement of the other portion, both first and second portions being in engagement with one another and being movable together in response to selected pressure levels until the stop means limits movement of the one portion and at increased pressure levels the other portion continuing to move.

5. a fluid pressure switch according to claim 4 in which the pressure converter comprises a body formed with a shelf, and one portion comprising a converter member movably received on the shelf having a section projecting laterally beyond the shelf, the stop means removably engaging the laterally projecting section.

6. A fluid pressure switch according to claim 5 in which the body is generally circular in configuration with an annular shelf and the converter member is generally ring shaped, the said other portion comprising the surface of the body within the annular shelf.

7. A fluid pressure switch having a flexible membrane mounted in a housing and placed in direct communication with a fluid pressure source on one side thereof, the switch having a slidably mounted pressure converter disposed on the other side of the membrane in engagement therewith, the pressure converter being movable in response to selected pressure levels of the pressure source and being operatively coupled to an electric switch mounted in the housing to control its state of energization, characterized in that the pressure converter has first and second portions movable relative to one another and in engagement with the membrane, and stop means is mounted in the housing which limits movement of one portion while it permits movement of the other portion, both first and second portions being in engagement with one another and being movable together in response to selected pressure levels until the stop means limits movement of the one portion and at increased pressure levels the other portion continuing to move.

* * * * *